US010731372B1

(12) United States Patent
Nolen et al.

(10) Patent No.: US 10,731,372 B1
(45) Date of Patent: Aug. 4, 2020

(54) SMALL CELL FIBERGLASS COMMUNICATIONS UTILITY POLE

(71) Applicants: Dustin Kyle Nolen, Mount Olive, AL (US); Raymond George Thompson, Hoover, AL (US)

(72) Inventors: Dustin Kyle Nolen, Mount Olive, AL (US); Raymond George Thompson, Hoover, AL (US)

( * ) Notice: Subject to any disclaimer, the term of this patent is extended or adjusted under 35 U.S.C. 154(b) by 0 days.

(21) Appl. No.: 16/550,477

(22) Filed: Aug. 26, 2019

(51) Int. Cl.
*E04H 12/02* (2006.01)

(52) U.S. Cl.
CPC ..... *E04H 12/02* (2013.01)

(58) Field of Classification Search
CPC ..... E04H 12/02; E04H 12/2292; E04H 12/24; E04H 12/085; F16B 37/045
See application file for complete search history.

(56) References Cited

U.S. PATENT DOCUMENTS 2,841,634 A * 7/1958 Kimball ..... E04H 12/182 52/632
3,160,249 A * 12/1964 Pavlecka ..... F16B 5/0052 52/586.2
3,228,646 A * 1/1966 Lane ..... E04G 25/04 248/354.3
3,848,844 A * 11/1974 Barrett ..... A47B 57/56 248/245
4,142,343 A * 3/1979 Trafton ..... E04C 3/32 248/219.1
4,194,338 A * 3/1980 Trafton ..... E04C 3/32 256/65.03
4,458,455 A * 7/1984 Tollstoff de Voss .... F16B 12/32 52/127.11
5,175,971 A * 1/1993 McCombs ..... E04H 12/02 52/843
5,864,998 A * 2/1999 Loomer ..... B66C 6/00 52/271
5,941,399 A * 8/1999 Wang ..... F16B 12/32 211/187
5,979,119 A * 11/1999 Trafton ..... E04B 1/2403 52/40
6,042,066 A * 3/2000 Maharg ..... A47B 96/1425 248/200.1

(Continued)

*Primary Examiner* — James M Ference
(74) *Attorney, Agent, or Firm* — Lanier Ford Shaver & Payne, PC; Gerald M. Walsh

(57) ABSTRACT

Disclosed is a utility pole formed as a hollow tube having a pentagonal exterior surface with the junctions of the sides of the pentagon each forming a dove tail channel. An interior surface of the hollow tube is round to allow insertion of round reinforcing sleeves. A mounting member is configured for attachment to the dove tail channel on an exterior of the hollow tube by means of a cam fastener system in an interior of the mounting block. The cam fastener system has a plurality of cams mounted rotatably on a pair of hinges, configured to allow the cam fastener system to open and close in an interior of the dove tail channel. The cam fastener system can be directly inserted into or removed from a dove tail channel anywhere along the length of the dove tail channel by closing it. The cam fastener system fastens the mounting member to the dove tail channel by opening the cam fastener system when it is in the interior of the dove tail channel.

17 Claims, 6 Drawing Sheets

(56) References Cited

U.S. PATENT DOCUMENTS 6,119,317 A * 9/2000 Pfister ..... F16M 11/24 24/514
6,357,196 B1 * 3/2002 McCombs ..... E04C 3/14 138/166
6,382,436 B1 * 5/2002 Wang ..... A47B 57/26 211/187
6,554,235 B1 * 4/2003 Fortier ..... A47B 57/565 248/122.1
6,726,034 B2 * 4/2004 Holbrook ..... A47B 57/565 211/103
7,063,096 B2 * 6/2006 Stoeckler ..... E04H 15/46 135/114
7,116,282 B2 * 10/2006 Trankina ..... E04H 12/2292 52/845
7,178,765 B2 * 2/2007 Huang ..... A47B 21/00 248/122.1
8,322,105 B2 * 12/2012 Williams ..... E04H 12/02 52/651.01
8,474,221 B1 * 7/2013 Ceko ..... H02G 7/20 174/45 R
9,121,194 B2 * 9/2015 Chan ..... E04H 12/003
9,347,213 B1 * 5/2016 Zhang ..... E04B 1/40
9,837,698 B2 * 12/2017 Lasier ..... H01Q 1/06
9,982,837 B2 * 5/2018 Zhang ..... F16L 3/10
9,989,169 B2 * 6/2018 Patil ..... F16L 3/10
2002/0011193 A1 * 1/2002 Beck ..... A47B 83/001 108/50.01
2006/0283399 A1 * 12/2006 Bolduc ..... A63B 1/005 119/705
2007/0023374 A1 * 2/2007 Nawrocki ..... A47F 5/0846 211/90.01
2007/0266670 A1 * 11/2007 Williams ..... E04C 3/28 52/843
2018/0023605 A1 * 1/2018 Ucgun ..... A63B 3/00 482/92
2018/0238074 A1 * 8/2018 Ehrlich ..... E04H 12/32

* cited by examiner

SMALL CELL FIBERGLASS COMMUNICATIONS UTILITY POLE

FIELD OF THE INVENTION

The present disclosure relates to outdoor equipment and systems that support mobile and cellular communication and, more particularly, to a utility, small cell, smart pole manufactured from fiberglass polyester composites and having a mounting system for accessories.

BACKGROUND OF THE INVENTION

Communication lines are supported above ground by utility poles. Traditionally, utility the poles are made from steel. Steel utility poles are subject to corrosion and are conductive of electricity. In order to avoid conductivity problems, steel utility poles must be provided with heavy insulation which increases their weight and expense. The high weight of steel utility poles makes them difficult to install. The expense of fabricating steel utility poles is high, particularly including the necessary insulation, and significantly more than the cost of fabricating utility poles using composite pultruded material.

U.S. Pat. No. 5,175,971 discloses a utility power pole system that is made by a process involving the pultrusion of glass reinforced fiber material. The exterior surface of the pole has a hexagonal cross section, with the vertex of the hexagon having a dove tail groove. The power pole system includes an accessory attachment device for attaching at least one accessory member to the power pole, the accessory attachment device being mounted in the dove tail groove. The accessory attachment device comprises an inside fastener positioned in the dove tail groove. The inside fastener has a shape complementary to the shape of the dove tail groove so the inside fastener can be inserted into the dove tail groove only at the free ends of the dove tail groove. The free ends exist only at the top end and bottom end of the pole. Thus, removing an inside fastener from the dove tail groove would be cumbersome, inconvenient, and time consuming because an inside fastener in the middle of a long pole, for example, would have to be moved all the way to an open end of the pole. Any intervening fasteners would also have to be removed. What is needed is an inside fastener that can be pushed into or pulled out of the dove tail groove without having to move the inside fastener up or down the pole.

SUMMARY OF THE INVENTION

The present invention is utility pole which is a hollow tube having an exterior surface generally pentagonal in cross section. Each side of the pentagon forming the exterior surface is generally flat and each junction of the sides of the pentagon forming the external surface have a dove tail channel. Preferably, the dove tail channel is generally trapezoidal shaped. An interior surface of the hollow tube has a round or circular cross section. A mounting member is configured for attachment to the dove tail channel on an exterior of the hollow tube.

A cam fastener system is positioned in an interior of the mounting block for attachment of the mounting block to the dove tail channel. The cam fastener system has a plurality of cams mounted rotatably on a pair of hinges, configured to allow the cam fastener system to open and close in an interior of the dove tail channel. Closing the cam fastener decreases the width of the cam fastener system and opening the cam fastener increases its width. One cam on one hinge of the pair of hinges is positioned between two cams on the other hinge of the pair of hinges and one cam on the other hinge of the pair of hinges is positioned between two cams on the one hinge of the pair of hinges.

The cams in the cam fastener system each have an open center and the cams are arranged in series rotatably on a center post inserted through the open centers. A threaded hole is formed in a center of the center post and is constructed to receive a bolt that is inserted through the mounting member. Half of the cams on the center post are on one side of the threaded hole and the other half of the cams on the center post are on an opposite side of the threaded hole.

When the hinge pins are moved closer to each other the width of the cam fastener system is reduced, forming a closed position. When the hinge pins are moved away from each other the width of the cam fastener system is increased, forming an open position. When the bolt in the mounting member is threaded into the threaded hole of the center post the cam fastener system is pulled towards a bottom of the mounting member. As the bolt is tightened in the threaded hole the cams are pressed against the bottom of the mounting member and the cams rotate the hinges away from each other, opening the cam fastener system and increasing its width.

The cam fastener system can be inserted directly into the dove tail channel when it is closed. When the cam fastener is in the interior of the dove tail channel it can be opened. When it is opened it cannot be removed from the dove tail channel and it will retain the mounting block against the dove tail channel. Loosening the bolt allows the cam fastener system to close so that it can be easily removed from the dove tail channel.

An advantage of the present invention are utility poles that can be made of fiberglass polyester composites using a pultrusion manufacturing process and that can be easily manufactured up to 50 feet and above.

Another advantage is a cam fastener system that can be directly inserted into or removed from a dove tail channel anywhere along the length of the dove tail channel by closing the cam fastener system.

Another advantage is a mounting member that can easily open and close the cam fastener system with a bolt at its external surface.

Another advantage is cam fastener system that allows a utility pole to be rapidly deployed at a relatively minimum cost, compared to existing systems.

DETAILED DESCRIPTION OF THE INVENTION

While the following description details the preferred embodiments of the present invention, it is to be understood that the invention is not limited in its application to the details of arrangement of the parts illustrated in the accompanying figures, since the invention is capable of other embodiments and of being practiced in various ways.

Figure 1:
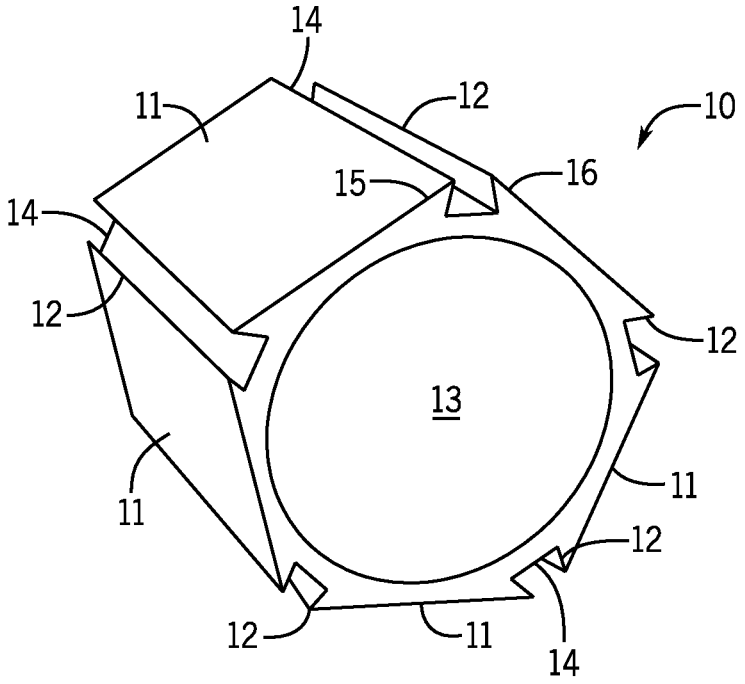
FIG. 1. is a perspective end view of a portion of a pentagonal-shaped utility pole of the present invention.

FIG. 1 shows a perspective end view of a portion of a pentagonal-shaped utility pole 10 of the present invention. The exterior of the pole 10 has a cross-sectional shape of a pentagon while the interior 13 of the pole 10 has a circular cross-sectional shape. The pentagon has five sides 11 and at the junction of adjacent sides is a trapezoidal-shaped dove tail channel 12 having an interior 14. The pole 10 may be of any desired length.

Figure 2:
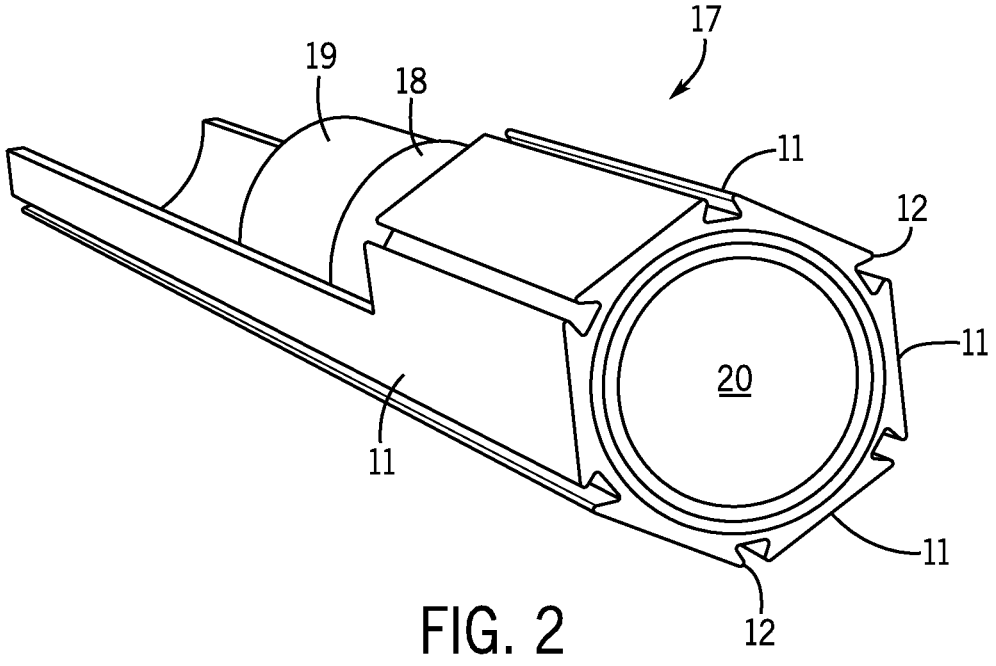
FIG. 2. is a perspective end view of a portion of a hexagonal-shaped utility pole of the present invention, further showing reinforcement sleeves inserted into the interior of the pole.

FIG. 2. is a perspective end view of a portion of a hexagonal-shaped utility pole 17, for example, of the present invention, further showing that inner sleeves 18 and 19 may be inserted into the interior of the pole 17 or pole 10 to provide increased strength and rigidity to the poles. The sleeves are round and of different diameters 20 so that a number of sleeves can be inserted one into another as desired. The sleeves can vary in length and thickness as desired to provide varying amounts of strength and rigidity. The pentagonal shape is preferred because it provides better strength compared to the hexagonal shape.

Figure 3:
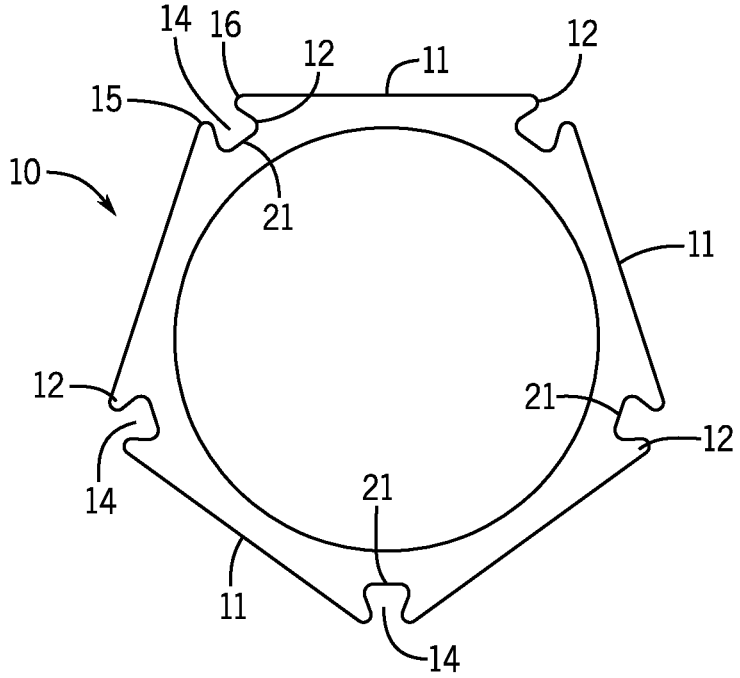
FIG. 3 is a sectional view of the pentagonal-shaped utility pole of FIG. 1.

FIG. 3 is a sectional view of the pentagonal-shaped utility pole 10. FIG. 3 further shows that the dove-tail channel 12 has a first side 15, a second opposite side 16, and a bottom 21.

Figure 4:
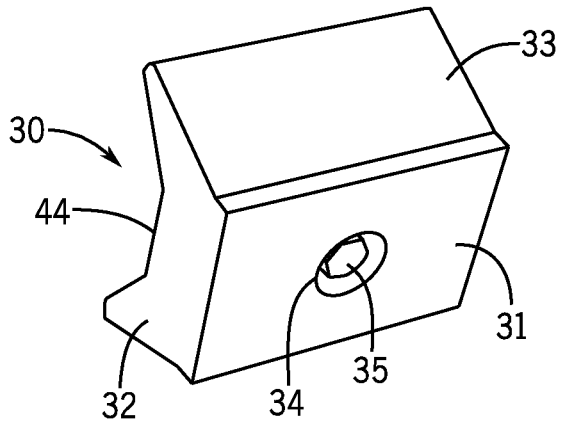
FIG. 4 is a front, side perspective view of a mounting member for mounting accessories to the utility pole.

FIG. 4 shows a mounting member 30 for a mounting accessories to the utility pole 10. The mounting member 30 is contoured to fit over the dove tail channel 12 and the adjoining sides 11. The mounting member 30 has a front 31, a first side 32, a second opposite side 33, and a bottom 44. The front has a hole 34 for insertion of a bolt 35.

Figure 5:
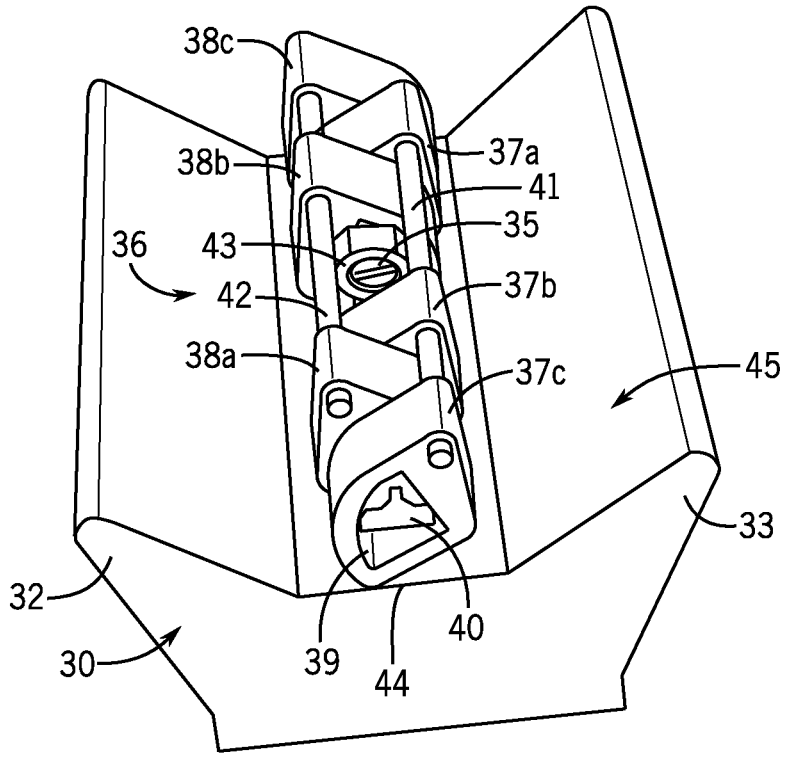
FIG. 5 is a side perspective view of a cam fastener system in a closed configuration placed inside the mounting member.

FIG. 5 shows a cam fastener system 36 in a closed configuration placed in an interior 45 of the mounting member 30. Several cams, 37*a*, 37*b*, 37*c*, 38*a*, 38*b*, and 38*c*, each having an open center 39, are arranged in series rotatably on a center post 40 inserted through the open centers 39. Cams 37*a*, 37*b*, and 37*c* are hinged rotatably in series with a hinge pin 41 on a first side of the cam fastener system 36. Cams 38*a*, 38*b*, and 38*c* are hinged rotatably in series with a hinge pin 42 on a second opposite side of the cam fastener system 36. When the hinge pins 41, 42 are moved closer to each other the width of the cam fastener system 36 is reduced, forming a closed position. When the hinge pins 41, 42 are moved away from each other the width of the cam fastener system 36 is increased, forming an open position. A threaded hole 43 is formed in a center of the center post 40 and is constructed to receive the bolt 35 in the mounting member 30. When the bolt 35 is threaded into the threaded hole 43 the cam fastener system 36 is pulled towards the bottom 44 of the mounting member 30. As the bolt 35 is tightened in the threaded hole 43 the cams are pressed against the bottom 44 of the mounting member 30 and the cams rotate the hinges 41, 42 away from each other, opening the cam fastener system 36 and increasing its width.

Figure 6:
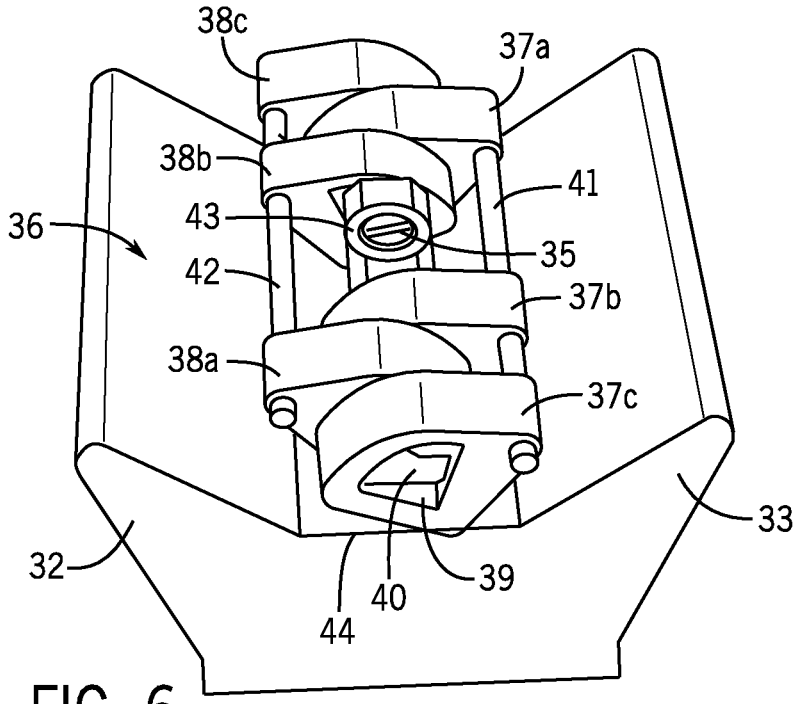
FIG. 6 is a side perspective view of the cam fastener system in an open (locked) configuration inside the mounting member.

FIG. 6 shows the cam fastener system 36 in the open position. In this configuration the width of the cam fastener system is greater than the opening of the dove tail channel 12 and the mounting member 30 becomes tightly fastened to the dove tail channel 12. FIG. 3 shows a first edge 15 and a second opposite edge 16 of the dove tail channel 12. The length between the edges 15 and 16 is less than width of the bottom 21 of the dove tail channel 12 because of its trapezoidal configuration. Any object in the dove tail channel that has a width the same as the bottom 21 is retained within the interior 14 of the dove tail channel 12.

Half of the cams on the center post 40 are on one side of the threaded hole 43 and the other half of the cams on the center post 40 are on an opposite side of the threaded hole 43. One cam on one hinge 41 is positioned between two cams on the other hinge 42 and one cam on the other hinge 42 is positioned between two cams on the one hinge 42. The center post 40 is, preferably, in the shape of a half-circle as seen in FIGS. 5 and 6.

Figure 7:
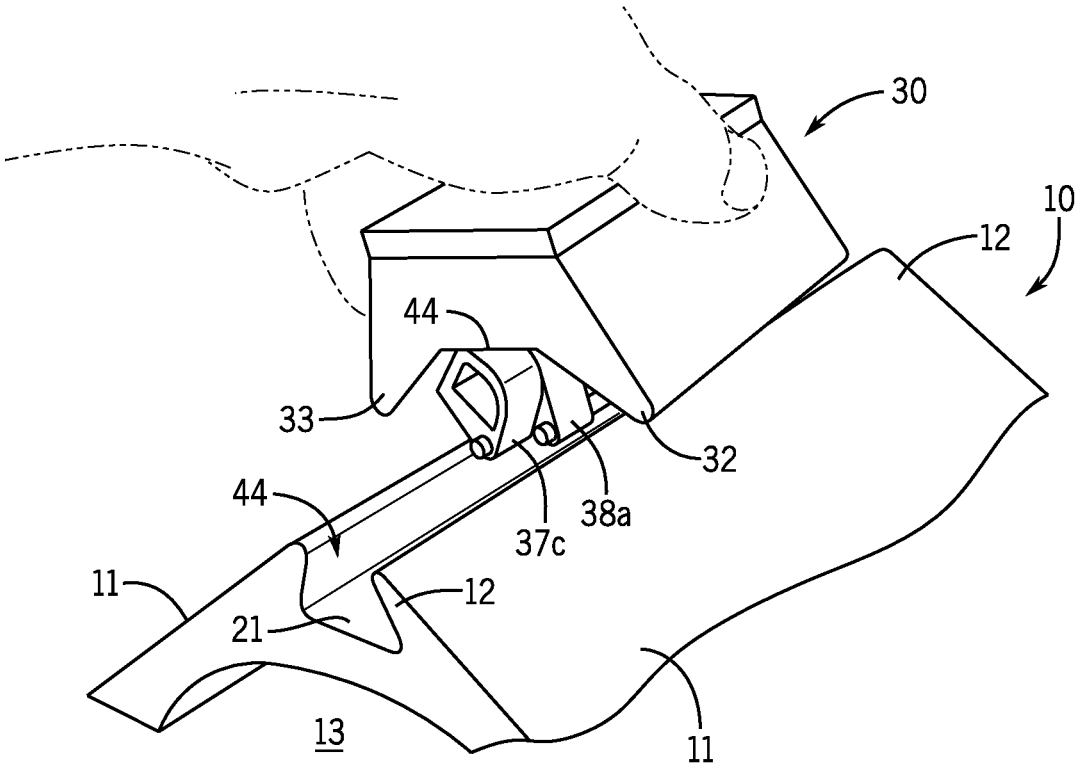
FIG. 7 is a perspective view of the mounting member and the cam fastener system, with the cam fastener system in a closed configuration and positioned near a dove tail channel for insertion into the dove tail channel at a desired location.
Figure 8:
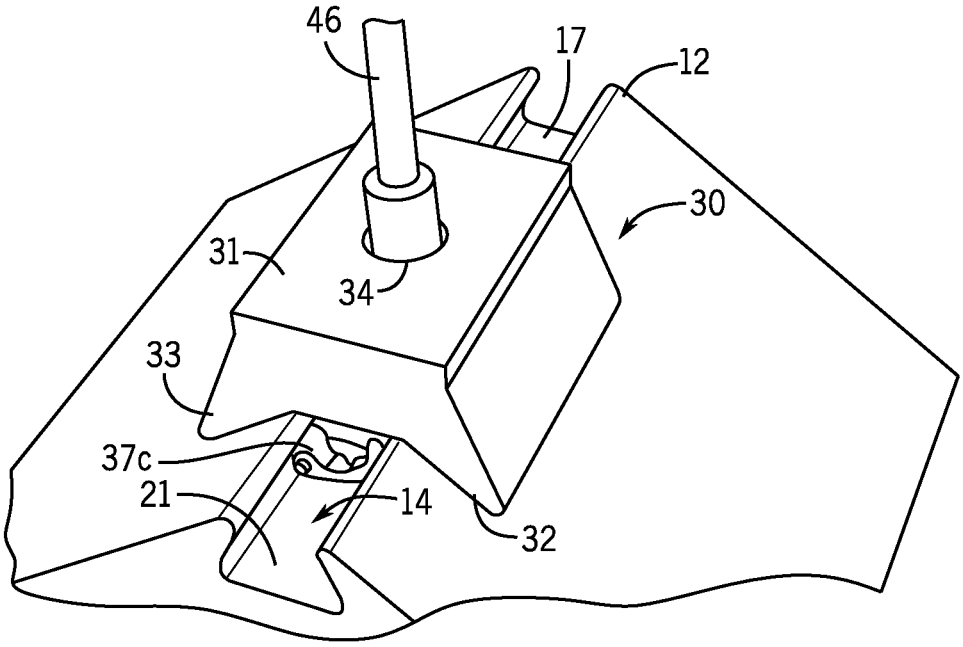
FIG. 8 perspective view of the mounting member and the cam fastener system, with the cam fastener system inserted into the interior of the dove tail channel and put into an open configuration to attach the mounting member to the dove tail channel.
Figure 9:
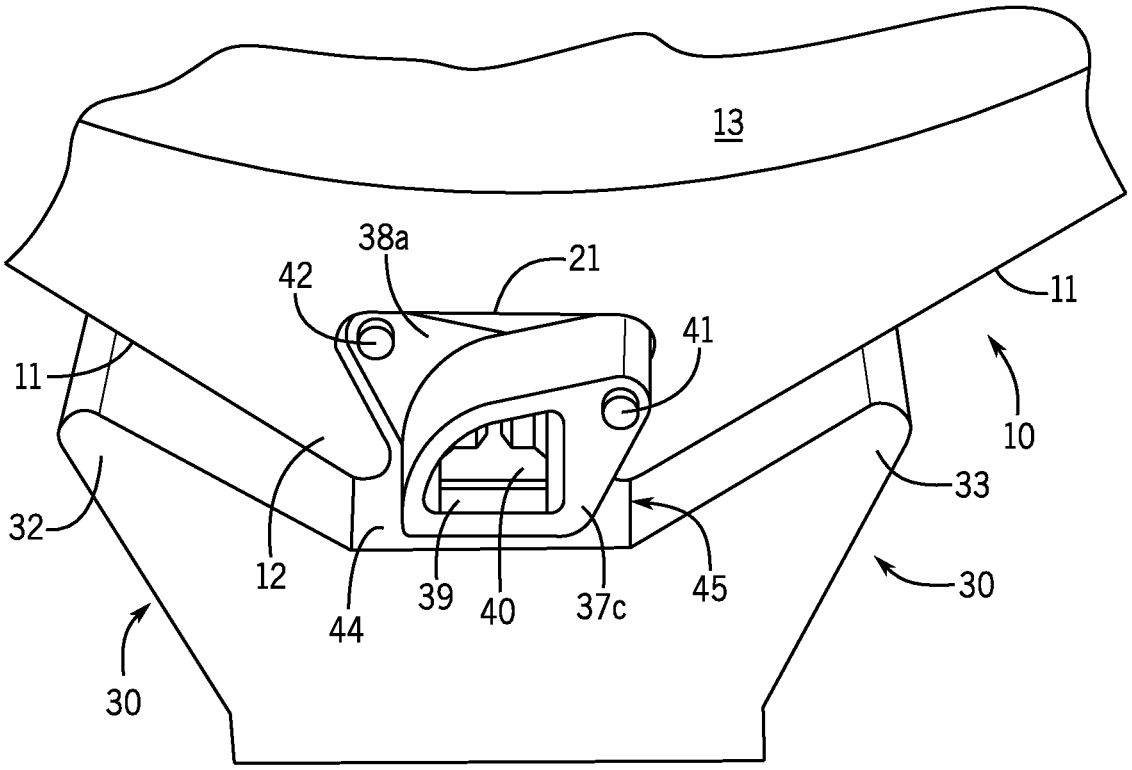
FIG. 9 is an enlarged view of the cam fastener system in the interior of the dove tail channel in an open configuration.

FIG. 7 is a perspective view of the mounting member 30 and the cam fastener system 36, with the cam fastener system 36 in a closed configuration and positioned near a dove tail channel 12 for insertion into the dove tail channel 12 at a desired location. FIG. 8 is a perspective view of the mounting member 30 and the cam fastener system 36, with the cam fastener system 36 inserted into the interior 14 of the dove tail channel 12. The cam fastener system 36 is put into an open configuration by screwing the bolt 35 into the threaded hole 43 with a wrench 45. The cam fastener system 36 is pulled against the bottom 44 of the mounting member 30 as the wrench 45 screws the bolt 35 into the threaded hole 43. Because the cam fastener system 36 widens to a length greater than the opening of the channel 12 at the edges 15 and 16, the cam fastener system 36 attaches the mounting member 30 to the dove tail channel 12. FIG. 9 is an enlarged view of the cam fastener system 36 in the interior 14 of the dove tail channel 12 in an open configuration.

Figure 10:
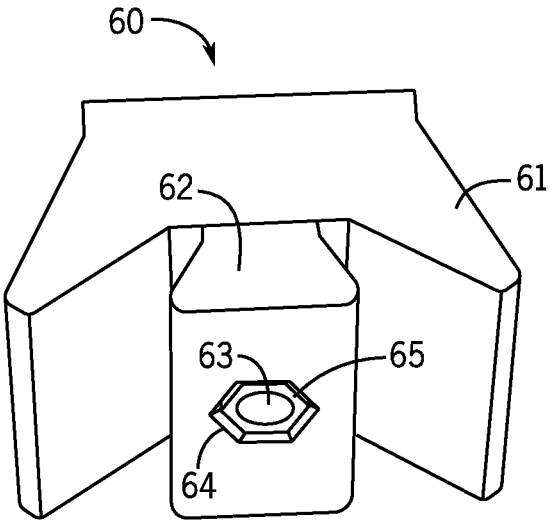
FIG. 10 shows an bottom view of an alternate embodiment of a fastener system.
Figure 11:
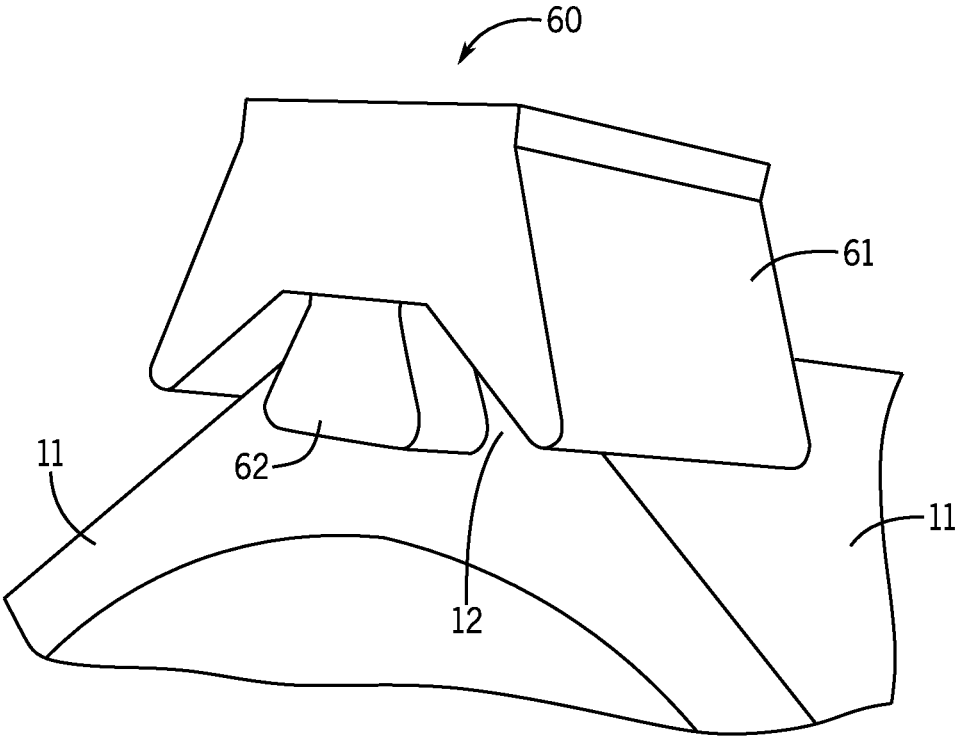
FIG. 11 shows a side view of the fastener system of FIG. 10 inserted in an open end of a dove tail channel of the utility pole.
Figure 12:
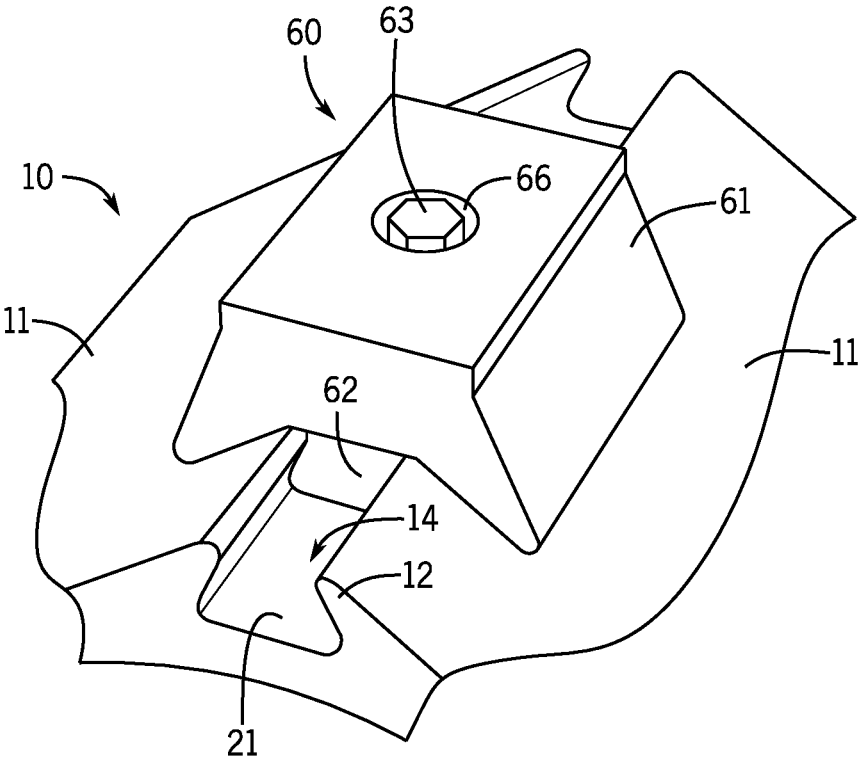
FIG. 12 shows a top view of the fastener system of FIG. 10 advanced along the dove tail channel to a desired location.

FIG. 10 shows a bottom view of an alternate embodiment of a fastener system 60. A mounting member 61 is bolted to a trapezoidal fastener 62 by means of a bolt 63 that passes through a hole 66 in the mounting member 61 (see FIG. 12) and through a hole 64 in the fastener 62 and that is secured with a nut 65. The fastener 62 has the same cross-sectional shape as the dove tail channel 12 (trapezoidal) so the fastener 62 can be inserted into an open end of the dove tail channel 12. FIG. 11 shows a side view of the fastener system 60 inserted into an open end of the dove tail channel 12. FIG. 12 shows a top view of the fastener system 60 advanced along the dove tail channel 12 to a desired location. As the bolt 63 is tightened on the mounting member 61 the fastener will tighten the mounting member against the dove tail channel 11 and the adjacent sides 11 of the utility pole 10, as described for the cam fastener system 36.

The mounting member allows placement of any fixture, instrument, display, luminaire, and/or hardware at any position on the pole. If for any reason the original placement of the mounting member is, or becomes, unsatisfactory or unnecessary, the bolt in the mounting member can be unscrewed, the cam fastener system loosens and closes, and the mounting member can easily and quickly be moved by sliding it anywhere along the length of the dove tail channel or withdrawing it from the dove tail channel and reinserting it.

The mounting member and the cam fastener system or trapezoidal fastener work best with small cell utility poles made of fiberglass polyester composites using a pultrusion manufacturing process. Another manufacturing method includes winding glass, carbon, other fiber around a mandrel using epoxy, vinyl ester, or thermoplastic polymers to form a matrix. The channels can be formed separately and attached to the pole by welding, fusing, gluing, fasteners or other suitable method. The inner sleeve options allow the utility poles to be specified to higher strengths when needed. Utility poles up to 50 feet and above are easily manufactured to a user's specification. The cam fastener system allows a utility pole to be rapidly deployed at a relatively minimum cost, compared to existing systems. These fiberglass poles with their plastic mounting members and fasteners require no painting, cutting, patching, upkeep, or maintenance.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the utility pole of the present invention can be used as any type of pole in addition to its use as a small cell communications utility pole. The dove tail channel may be made various shapes. The mounting member and cam fastener system may be made of any suitable materials such as plastics, metals, or a combination thereof.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A utility pole, comprising:

a) a hollow tube having an exterior surface generally pentagonal in cross section, the exterior surface formed of five generally flat sides, the sides forming junctions with each other therebetween on the exterior surface, each junction having a dove tail channel;

b) an interior surface of the hollow tube having a round cross section;

c) a mounting member configured for attachment to the dove tail channel on an exterior of the hollow tube;

d) a cam fastener system in an interior of the mounting member configured for attachment of the mounting member to the dove tail channel; and e) the cam fastener system having a plurality of cams mounted rotatably on a pair of hinges, configured to allow the cam fastener system to open and close in an interior of the dove tail channel.

2. The utility pole of claim 1 wherein closing the cam fastener decreases a width of the cam fastener system and opening the cam fastener increases the width of the cam fastener system.

3. The utility pole of claim 1 wherein each of the plurality of cams in the cam fastener system has an open center and wherein the plurality of cams is arranged in series rotatably on a center post inserted through the open centers.

4. The utility pole of claim 3 wherein a threaded hole is formed in a center of the center post and is constructed to receive a bolt in the mounting member.

5. The utility pole of claim 3 wherein half of the plurality of cams on the center post are on one side of the threaded hole and the other half of the plurality of cams on the center post are on an opposite side of the threaded hole.

6. The utility pole of claim 1 wherein one of said plurality of cams on one hinge of said pair of hinges is positioned between two of said plurality of cams on the other hinge of said pair of hinges and one of said plurality of cams on the other hinge of said pair of hinges is positioned between two of said plurality of cams on the one hinge of said pair of hinges.

7. A utility pole, comprising:

a) a hollow tube having an exterior surface generally pentagonal in cross section, the exterior surface formed of five generally flat sides, the sides forming junctions with each other therebetween on the exterior surface, each junction having a dove tail channel;

b) an interior surface of the hollow tube having a round cross section;

c) a mounting member configured for attachment to the dove tail channel on an exterior of the hollow tube;

d) a cam fastener system in an interior of the mounting member configured for attachment of the mounting member to the dove tail channel;

e) the cam fastener system having a plurality of cams mounted rotatably on a pair of hinges, configured to allow the cam fastener system to open and close in an interior of the dove tail channel; and f) each of the plurality of cams in the cam fastener system having an open center, wherein the plurality of cams is arranged in series rotatably on a center post inserted through the open centers.

8. The utility pole of claim 7 wherein the dove tail channel is generally trapezoidal shaped.

9. The utility pole of claim 7 wherein closing the cam fastener decreases a width of the cam fastener system and opening the cam fastener increases the width of the cam fastener system.

10. The utility pole of claim 7 wherein a threaded hole is formed in a center of the center post and is constructed to receive a bolt in the mounting member.

11. The utility pole of claim 7 wherein half of the plurality of cams on the center post are on one side of the threaded hole and the other half of the plurality of cams on the center post are on an opposite side of the threaded hole.

12. The utility pole of claim 7 wherein one of said plurality of cams on one hinge of said pair of hinges is positioned between two of said plurality of cams on the other hinge of said pair of hinges and one of said plurality of cams on the other hinge of said pair of hinges is positioned between two of said plurality of cams on the one hinge of said pair of hinges.

13. A utility pole, comprising:

a) a hollow tube having an exterior surface generally pentagonal in cross section, the exterior surface formed of five generally flat sides, the sides forming junctions with each other therebetween on the exterior surface, each junction having a dove tail channel;

b) an interior surface of the hollow tube having a round cross section;

c) a mounting member configured for attachment to the dove tail channel on an exterior of the hollow tube;

d) a cam fastener system in an interior of the mounting member configured for attachment of the mounting member to the dove tail channel;

e) the cam fastener system having a plurality of cams mounted rotatably on a pair of hinges, configured to allow the cam fastener system to open and close in an interior of the dove tail channel, wherein one of said plurality of cams on one hinge of said pair of hinges is positioned between two of said plurality of cams on the other hinge of said pair of hinges and one of said plurality of cams on the other hinge of said pair of hinges is positioned between two of said plurality of cams on the one hinge of said pair of hinges; and f) each of the plurality of cams in the cam fastener system having an open center, wherein the plurality of cams is arranged in series rotatably on a center post inserted through the open centers, wherein a threaded hole is formed in a center of the center post and is constructed to receive a bolt in the mounting member, and wherein half of the plurality of cams on the center post are on one side of the threaded hole and the other half of the plurality of cams on the center post are on an opposite side of the threaded hole.

14. The utility pole of claim 13 wherein the dove tail channel is generally trapezoidal shaped.

15. The utility pole of claim 13 wherein closing the cam fastener decreases a width of the cam fastener system and opening the cam fastener increases the width of the cam fastener system.

16. A utility pole, comprising:

a) a hollow tube having an exterior surface generally pentagonal in cross section, the exterior surface formed of five generally flat sides, the sides forming junctions with each other therebetween on the exterior surface, each junction having a dove tail channel;

b) an interior surface of the hollow tube having a round cross section;

c) a mounting member configured for attachment to the dove tail channel on an exterior of the hollow tube;

d) a cam fastener system in an interior of the mounting member configured for attachment of the mounting member to the dove tail channel;

e) the cam fastener system having a plurality of cams mounted rotatably on a pair of hinges, configured to allow the cam fastener system to open and close in an interior of the dove tail channel, wherein closing the cam fastener decreases a width of the cam fastener system and opening the cam fastener increases the width of the cam fastener system, wherein one of said plurality of cams on one hinge of said pair of hinges is positioned between two of said plurality of cams on the other hinge of said pair of hinges and one of said plurality of cams on the other hinge of said pair of hinges is positioned between two of said plurality of cams on the one hinge of said pair of hinges; and f) each of the plurality of cams in the cam fastener system having an open center wherein the plurality of cams is arranged in series rotatably on a center post inserted through the open centers, wherein a threaded hole is formed in a center of the center post and is constructed to receive a bolt in the mounting member, and wherein half of the plurality of cams on the center post are on one side of the threaded hole and the other half of the plurality of cams on the center post are on an opposite side of the threaded hole.

17. The utility pole of claim 16 wherein the dove tail channel is generally trapezoidal shaped.

* * * * *